US008229305B2

(12) United States Patent
Kinukawa et al.

(10) Patent No.: US 8,229,305 B2
(45) Date of Patent: Jul. 24, 2012

(54) IMAGE FORMING APPARATUS

(75) Inventors: Tatsuya Kinukawa, Mishima (JP); Kimitaka Ichinose, Suntou-gun (JP); Tomoaki Nakai, Numazu (JP); Takao Kume, Yokohama (JP); Masahide Hirai, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 543 days.

(21) Appl. No.: 12/468,488

(22) Filed: May 19, 2009

(65) Prior Publication Data

US 2009/0297185 A1 Dec. 3, 2009

(30) Foreign Application Priority Data

May 27, 2008 (JP) ..... 2008-138049
Apr. 6, 2009 (JP) ..... 2009-092312

(51) Int. Cl.
*G03G 15/06* (2006.01)

(52) U.S. Cl. ..... 399/43; 399/44; 399/48

(58) Field of Classification Search ..... 399/40, 399/43, 44, 48, 56
See application file for complete search history.

(56) References Cited

U.S. PATENT DOCUMENTS 5,708,917 A * 1/1998 Kawai et al. ..... 399/58
6,339,441 B2 1/2002 Suzuki
2008/0175608 A1 * 7/2008 Kobashigawa ..... 399/44

FOREIGN PATENT DOCUMENTS

JP 2002-258550 A 9/2002
JP 2005-300745 A 10/2005

OTHER PUBLICATIONS

Machine translation of JP2002258550.*

* cited by examiner

*Primary Examiner* — David Gray
*Assistant Examiner* — Barnabas Fekete
(74) *Attorney, Agent, or Firm* — Fitzpatrick, Cella, Harper & Scinto

(57) ABSTRACT

An image forming apparatus which predicts VL fluctuates of a photosensitive drum, taking a rotation speed of the photosensitive drum during image formation into consideration, and controls the image formation based on the prediction, for always obtaining an image of a stable density. The image forming apparatus performs appropriate image formation control by controlling image forming conditions based on a photosensitive member rotation time, a photosensitive member stop time, a temperature of the environment, an absolute humidity of the environment, and the rotation speed of the photosensitive member.

15 Claims, 11 Drawing Sheets

FIG. 7A
TABLE A
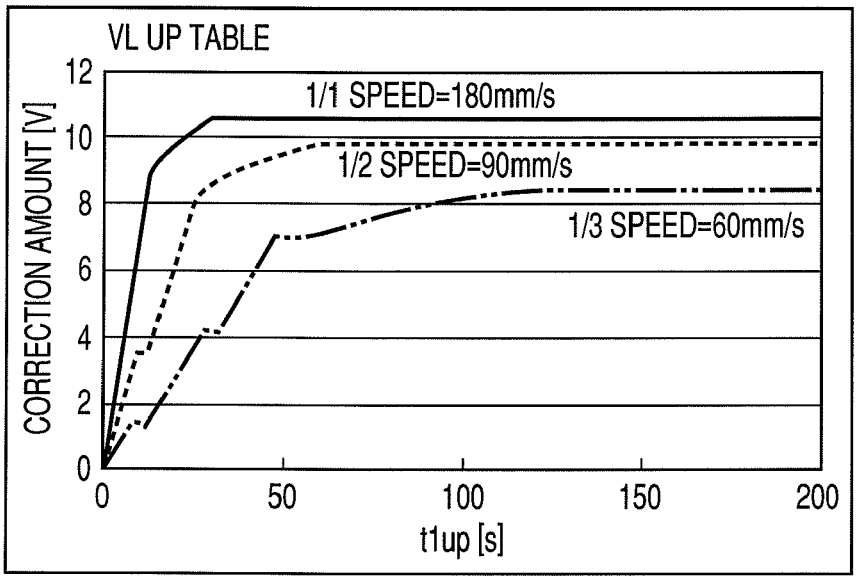
FIG. 7B
TABLE B
| (Vup SIDE) | | ABSOLUTE HUMIDITY: W (g/m$^3$) | | | |
|---|---|---|---|---|---|
| | | 0~2.0 | 2.1~4.0 | 4.1~6.0 | 6.1~ |
| TEMPERATURE: Tc (°C) | 0°C~13°C | 1.5 | 0 | 0 | 0 |
| | 14°C~20°C | 1 | 0 | 0 | 0 |
| | 21°C~26°C | 0.6 | 0 | 0 | 0 |
| | 27°C~ | 0 | 0 | 0 | 0 |
FIG. 7C
TABLE C
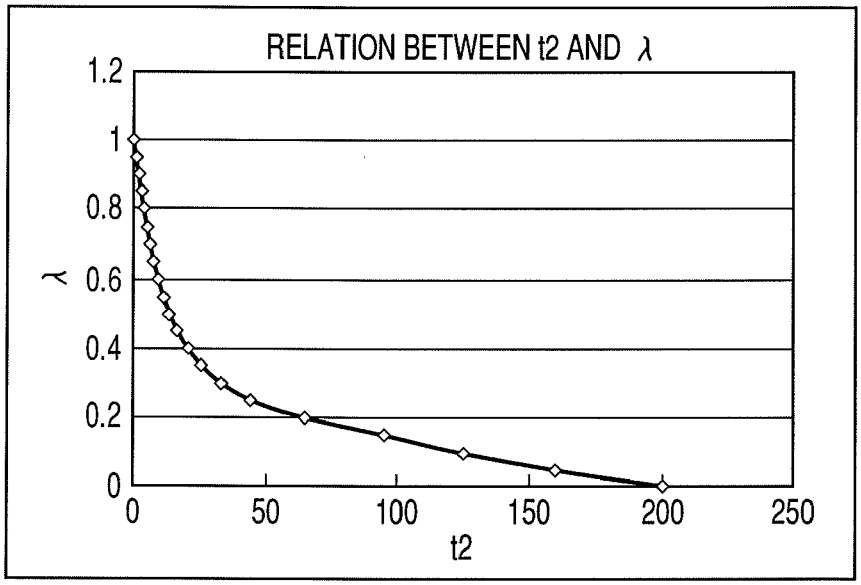

FIG. 8A
TABLE D
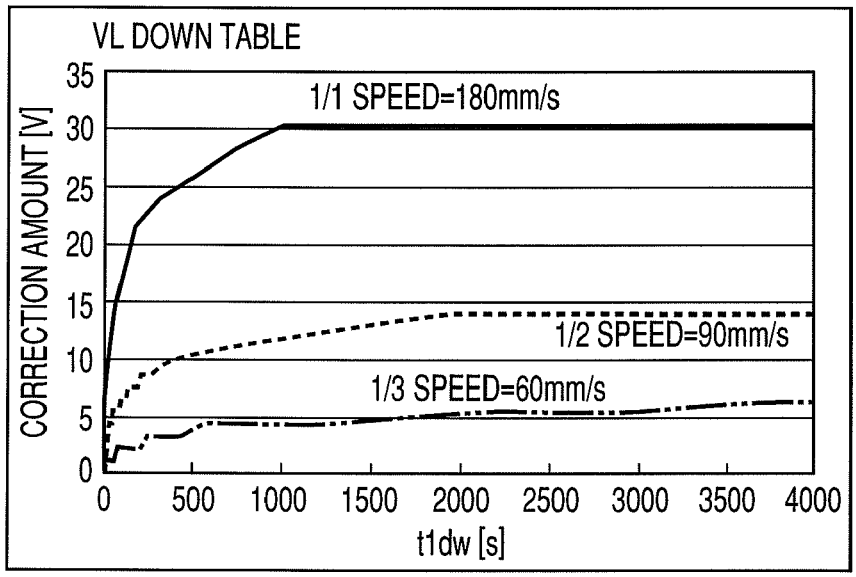
FIG. 8B
TABLE E
| (Vdw SIDE) | | ABSOLUTE HUMIDITY: W (g/m$^3$) | | | |
|---|---|---|---|---|---|
| | | 0~2.0 | 2.1~4.0 | 4.1~6.0 | 6.1~ |
| TEMPERATURE: Tc (°C) | 0°C~13°C | 1.5 | 0 | 0 | 0 |
| | 14°C~20°C | 1 | 0 | 0 | 0 |
| | 21°C~26°C | 0.6 | 0 | 0 | 0 |
| | 27°C~ | 0 | 0 | 0 | 0 |
FIG. 8C
TABLE F
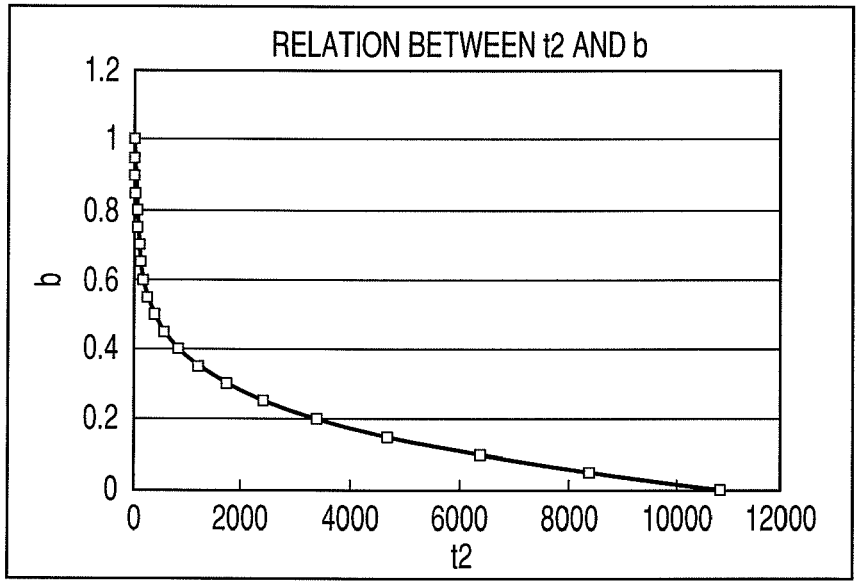

| FIG. 9A |
| --- |
| FIG. 9B |

IMAGE FORMING APPARATUS

BACKGROUND OF THE INVENTION

1. Field of the Invention

The present invention relates to an electrophotographic image forming apparatus such as a copier, a printer, or a facsimile machine.

2. Description of the Related Art

In general, an image forming apparatus that utilizes electrophotography has: a photosensitive member which serves as an image bearing member; a charging device (e.g., corona charger or charging roller) which charges a surface of the photosensitive member; an image exposure device for forming an electrostatic latent image on the photosensitive member; a developing device for developing the electrostatic latent image; a transfer device for transferring a toner image to a transfer material; a cleaning device which cleans residual toner off the photosensitive member; a residual charge eliminating exposure device for eliminating the electrostatic latent image on the photosensitive member; and a fixing device for fixing the toner image on the transfer material.

In the conventional image forming apparatus utilizing electrophotography, the photosensitive member which holds toner onto an electrostatic latent image generally has a photoconductive layer that includes a charge generation layer and a charge transport layer.

The photosensitive member moves by being driven in a given direction in response to a "start printing" signal.

The charging device applies a bias to the photosensitive member to charge the surface of the photosensitive member to a given electric potential (hereinafter referred to as a charging step).

The surface potential at this stage is called a VD potential. The surface of the photosensitive member is then irradiated with laser light or LED light which is controlled to be turned on/off based on a signal from a controller (hereinafter referred to as an exposure step). A spot on the photosensitive member that is irradiated with light is reduced in electric potential, and thus an electrostatic latent image is formed on the surface of the photosensitive member. The electric potential of a spot irradiated with light is called a VL potential.

Subsequently, a developing bias is applied to the developing device, which is placed to face the photosensitive member and which is filled with toner. This shifts the toner charged to a given level onto an electrostatic latent image on the photosensitive member, which is a photosensitive drum or the like, thereby turning the electrostatic latent image into a toner image (hereinafter referred to as a developing step). A developing bias is denoted by Vdev.

Thereafter, a bias having a polarity opposite to that of the toner on the photosensitive member is applied to the transfer member, which is a transferring roller placed adjacent to the photosensitive member and moving in the forward direction at approximately the same speed as the photosensitive member. In this state, the transfer material passes between the photosensitive member and the transfer member, with the result that the toner on the photosensitive member is transferred to the transfer material (hereinafter referred to as a transfer step).

The exposure step sometimes generates residual charges in the photosensitive member, causing VL to fluctuate during an image formation. VL fluctuates also due to a friction between the photosensitive member and components with which the photosensitive member is in contact, such as the charging member, the exposure member, and the cleaning member, and due to a rise in temperature that is caused by heat dissipated from the fixing device or other components while the photosensitive member is moving. In other words, the exposure and moving of the photosensitive member in the process of forming an image causes the fluctuation of the development contrast, which corresponds to the difference between Vdev and VL. The fluctuation leads to variations in how much toner the photosensitive member holds (toner bearing amount) and invites fluctuations in image density on the transfer material. The development contrast (i.e. the difference in potential between Vdev and VL) is denoted by Vcont.

An image forming apparatus has been proposed which stabilizes image density by detecting VL of the photosensitive member with a sensor and by controlling image forming conditions according to results of the detection (U.S. Pat. No. 6,339,441). A problem of this image forming apparatus is an increase in cost and apparatus size due to the installation of the sensor and a space for installing the sensor.

Another image forming apparatus reduces fluctuations in image density when forming the same image on multiple sheets by selecting an appropriate number of revolutions of the photosensitive member with the charge elimination step and the charging step prior to the formation of an electrostatic latent image in accordance with the temperature and humidity in the vicinity of the photosensitive member (Japanese Patent Application Laid-Open No. 2005-300745). However, increasing the number of revolutions of the photosensitive member before latent image formation is a problem because it slows down the printing speed and lowers the productivity of the image forming apparatus.

As a solution to the above-mentioned problem, an image forming apparatus has been proposed which predicts VL of the photosensitive member from the temperature around the photosensitive member, the photosensitive member rotation time, and the photosensitive member stop time (how long the photosensitive member remains still without rotating), and by executing process control based on the predicted VL (Japanese Patent Application Laid-Open No. 2002-258550).

A study conducted by the inventors of the present invention has discovered not only that image density is dependent on humidity, but also specifically that VL fluctuations in the process of image formation are dependent on the absolute humidity of the atmosphere and that VL fluctuations include a drop in absolute value of VL as well as a rise in absolute value of VL. Therefore, VL fluctuations cannot be predicted accurately with the conventional art proposed in Japanese Patent Application Laid-Open No. 2002-258550, where the absolute humidity of the atmosphere around the photosensitive member is not taken into consideration, nor is the possibility of both a rise in VL and a drop in VL happening with time as the photosensitive member rotation time "counts up" or increases. This conventional art is accordingly incapable of appropriate image formation control and of obtaining an image of uniform or stable density. Hereinafter, a phenomenon that acts to raise the absolute value of VL with time as the photosensitive member rotation time counts up is referred to as "VL UP" and a phenomenon that acts to lower the absolute value of VL with time as the photosensitive member rotation time counts up is referred to as "VL DOWN".

FIG. 2 is a conceptual diagram of the surface potential of a photosensitive member. As illustrated in FIG. 2, the difference between Vdev and VL, "Vdev−VL", corresponds to Vcont. A larger Vcont means more toner is available to be developed on the photosensitive member and an accordingly higher image density. VL UP is a phenomenon where VL shifts in a direction indicated by an arrow A of FIG. 2 (direction in which the absolute value of VL rises), thereby reducing Vcont and lowering the image density. VL DOWN, on the other hand, is a phenomenon where VL shifts in a direction indicated by an arrow B of FIG. 2 (direction in which the absolute value of VL falls), thereby increasing Vcont and raising the image density.

VL UP and VL DOWN will be described below in detail.

Phenomena relevant to VL UP will be described first. In an L/L environment (low temperature-low humidity environment), for example, an environment where the temperature and the humidity are 15° C./10% RH, a continuous image formation even if only for several sheets causes the VL UP due to the image formation as illustrated in FIG. 3A. A study conducted by the inventors of the present invention has confirmed that the rate of increase in VL per unit time in the VL UP phenomenon is greater in an environment where the absolute humidity is lower.

VL UP is influenced by how long the photosensitive member has been stopped before image formation. As the photosensitive member stop time before the image formation increases, the amount of increase in VL occurring over the elapse of time from the start of rotation of the photosensitive member becomes larger. For instance, VL rises to V1 as illustrated in FIG. 3A when the photosensitive member stop time is long whereas, when the photosensitive member stop time is short, VL rises only to V2, which is smaller than V1, as illustrated in FIG. 3B.

The inventors of the present invention believe that the main cause of the VL UP phenomenon is an increase in number of residual charges in the photoconductive layer due to the exposure of the photosensitive member during image formation. To elaborate, the inventors believe that the cause of VL UP in an environment where the absolute humidity is low is an increased resistance of one of layers in the photoconductive layer which inhibits smooth movement and injection of electric charges. Forming an image in an environment where the absolute humidity is low thus causes residual charges to accumulate in a high resistance layer and results in VL UP. One way to predict the amount of VL UP is to estimate a time for image formation on the basis of the photosensitive member rotation time.

Residual charges generated in the process of forming an image gradually leave from the photoconductive layer to the ground after the image formation is completed and stopped. As the image formation stop time is longer, residual charges generated in the previous image formation becomes less so that the photosensitive layer falls into a state in which residual charges are prone to accumulate in the subsequent image formation. Therefore, as an image formation stop time is longer, influence of VL UP becomes more conspicuous and an amount of increase in VL becomes larger in the subsequent image formation.

The VL DOWN phenomenon will be described below. When a continuous image formation is performed, VL drops with time as the photosensitive member rotation time counts up as illustrated in FIG. 3C.

VL lowered by VL DOWN exhibits a tendency to return to a level closer to the original VL level when there has been a period of time without any image formation after a time of image formation, namely, the photosensitive member stop time, is longer. For instance, VL DOWN due to the precedent image formation lowers VL in the precedent image formation to V4 as illustrated in FIG. 3C. This VL DOWN occurs during the photosensitive member rotation time, i.e. during the precedent image formation. The initial VL in the subsequent image formation takes a value closer to V3, which is the original VL level, as the photosensitive member stop time is longer as illustrated in FIG. 3D.

The inventors of the present invention believe that the main cause of VL DOWN is a decrease in number of residual charges in the photoconductive layer. To elaborate, forming an image raises the temperature of the photosensitive member, thereby lowering the resistance of the photoconductive layer, and thus the inventors of the present invention believe that the cause of VL DOWN is the lowered photoconductive layer resistance which allows residual charges trapped in the photoconductive layer to exit the photosensitive member. VL DOWN thus takes place when the temperature of the photosensitive member rises with time as the photosensitive member rotation time counts up, which lowers the resistance of the photoconductive layer and reduces trapped residual charges. Factors that raise the temperature of the photosensitive member with time as the photosensitive member rotation time counts up are friction with members that are in contact with the photosensitive member, such as the developing member, the charging member, and the cleaning member, and heat dissipation from the fixing device and other components.

Depending on the temperature and humidity of an atmospheric environment where the image forming apparatus is set, one or both of VL UP and VL DOWN take place. In one environment, VL rises once and then drops as illustrated in FIG. 3E. In a different environment, VL falls once and then rises as illustrated in FIG. 3F.

As described above, VL fluctuations have absolute humidity-related factors in addition to temperature-related factors such as the temperature of an environment in which the image forming apparatus is set, the temperature inside the image forming apparatus, or the temperature around or of the photosensitive member itself. Appropriate image formation control and an image of uniform density therefore cannot be obtained with the conventional art proposed in Japanese Patent Application Laid-Open No. 2002-258550 which does not include predicting VL fluctuations.

Also, in the conventional art proposed in Japanese Patent Application Laid-Open No. 2002-258550, an image formation is controlled on the premise that only one of VL UP and VL DOWN takes place. Therefore, there is a problem in that, when both VL UP and VL DOWN occur during the production of a single image, an appropriate image formation control is not accomplished so that an image with uniform density cannot be obtained.

A study conducted by the inventors of the present invention has also revealed for the first time that VL fluctuations are dependent on the rotation speed of the photosensitive member. The VL DOWN amount of the photosensitive drum has been discovered to be smaller in print modes where the photosensitive member rotation speed is low, such as a thick paper print mode and a gloss paper print mode, than in a plain paper print mode where the transfer material is transported at a higher speed, even when the movement distances of the photosensitive member in the former and latter modes are the same as each other.

A reason for this is that friction with a member that is in contact with the photosensitive member, for example, the charging member, the exposure member, or the cleaning member, affects the respective member differently depending on the rotation speed of the photosensitive member, and hence the temperature of the photosensitive member rises more slowly at a lower photosensitive member rotation speed, when there is less energy transferred through friction.

Conventional art as the one proposed in Japanese Patent Application Laid-Open No. 2002-258550 only predicts VL fluctuations in a high-speed print mode such as a plain paper print mode, and does not consider the difference in VL potential fluctuations between the high-speed print mode and a low-speed print mode (e.g., thick paper print mode or gloss paper print mode). Conventional art therefore has a problem in that an image of uniform density cannot be obtained when printing is executed in one of the low-speed print modes.

SUMMARY OF THE INVENTION

It is desirable to solve the above-mentioned problems of the conventional art. Specifically, it is desirable to provide a user with an excellent image by controlling image forming conditions in a manner suited to a rotation speed of a photosensitive member.

Further features of the present invention become apparent from the following description of exemplary embodiments with reference to the accompanying drawings.

BRIEF DESCRIPTION OF THE DRAWINGS

FIGS. 7A, 7B, and 7C are diagrams illustrating the contents of a VL UP table according to the present invention.

FIGS. 8A, 8B, and 8C are diagrams illustrating the contents of a VL DOWN table according to the present invention.

DESCRIPTION OF THE EMBODIMENT

An embodiment of the present invention will be described below with reference to the drawings.

First Embodiment

Figure 4:
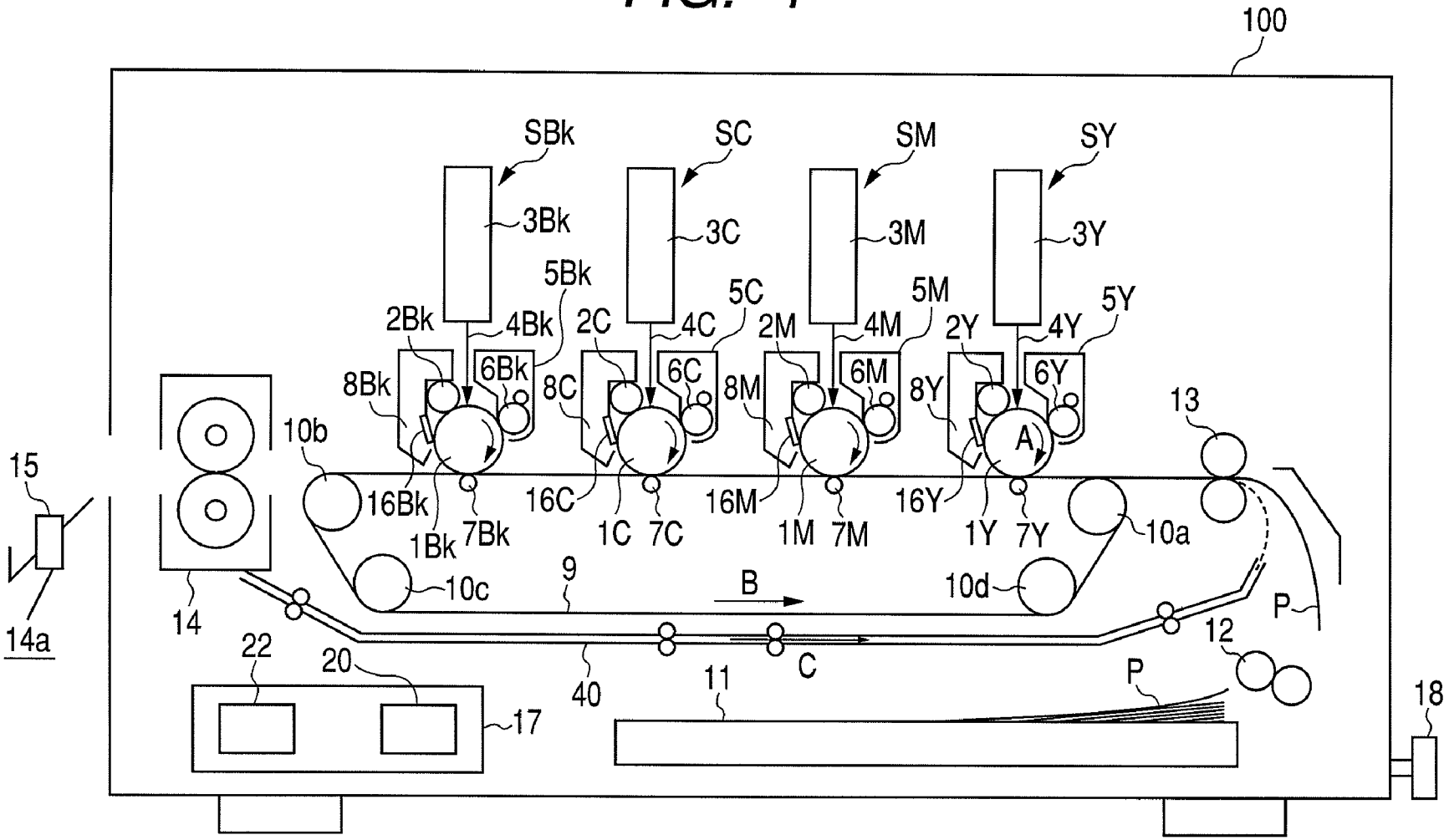
FIG. 4 is a diagram illustrating a structure of an image forming apparatus according to the present invention.

FIG. 4 illustrates a schematic structure of an image forming apparatus of this embodiment. An image forming apparatus 100 of this embodiment is a laser beam printer which forms an image through an electrophotographic image formation process on a recording medium (transfer material), for example, recording paper, an OHP sheet, or cloth.

The image forming apparatus 100 of this embodiment has cylindrical photosensitive drums 1 (specifically 1BK, 1C, 1M and 1Y representing black, cyan, magenta and yellow drums respectively) each serving as an image bearing member and being supported in a manner that allows the photosensitive drum 1 to rotate about its axis in a direction indicated by an arrow A of FIG. 4. When an image formation operation is started, a surface of a rotating photosensitive drum 1Y is uniformly charged to a negative potential by roller-shaped charging means (charging roller) 2Y. Thereafter, an exposure device 3Y scans and exposes the surface of the photosensitive drum 1Y using light 4Y based on image information, to thereby form an electrostatic latent image on the surface of the photosensitive drum 1Y. The latent image formed on the photosensitive drum 1Y is developed when a developing device 5Y supplies yellow toner (hereinafter referred to as Y toner) to the latent image.

The developing device 5Y applies a developing bias to a developing sleeve 6Y, whereby the latent image written on the photosensitive drum 1Y is formed as a Y toner layer. The Y toner layer is transferred, when a transferring bias is applied to a transfer roller 7Y, to a surface of a transfer material P on a transfer belt 9 which is fed from a sheet-feeding cassette 11 via sheet feeding rollers 12 and 13. The transfer material P (such as a sheet of paper) may alternatively be supplied through conduit 40 in the direction of arrow C. Toner remaining on the surface of the photosensitive drum 1Y without being transferred to the transfer material P is removed by a cleaning blade 16Y and then contained in an waste toner container 8Y.

The transfer belt 9 is stretched over four rollers 10*a*, 10*b*, 10*c*, and 10*d*, and rotates in a direction indicated by an arrow B of FIG. 4 to carry the transfer material P on its surface and transport the transfer material P to image formation stations SY, SM, SC, and SBk sequentially.

The above-mentioned processing is performed also in the stations for other colors, namely, the stations SM (magenta), SC (cyan), and SBk (black), thereby forming a toner image (developer image) which is formed of superimposed toner layers of different colors on the transfer material P. Past the roller 10*b* placed on a downstream side of the transfer belt 9, a fixing device 14, which is placed further downstream of the roller 10*b*, melts and fixes the toner image transferred to the surface of the transfer material P. The transfer material P is then delivered onto a tray 15 which is placed outside the color image forming apparatus 100.

In this embodiment, the photosensitive drums 1, the transfer belt 9, and the fixing device 14 have different rotation driving speeds (i.e., process speeds) for different types of transfer material P to be printed on. Image formation in this embodiment uses one of three process speeds, 180 mm/sec, 90 mm/sec, and 60 mm/sec, depending on the type of the transfer material P. The image forming apparatus includes speed-switching means for switching from one process speed to another.

When printing plain paper that has a basis weight of 90 g/m$^2$, the productivity is given utmost priority by forming an image at a process speed of 180 mm/sec (hereinafter the print mode in which plain paper is printed is referred to as 1/1 speed mode). When printing thick paper that has a basis weight exceeding 90 g/m$^2$, an image is formed at a process speed of 90 mm/sec, which is half the process speed in the plain paper print mode (hereinafter the print mode in which thick paper is printed is referred to as ½ speed mode). The process speed employed in printing a glossy transfer material such as gloss paper or a transparent transfer material such as an overhead transparency (OHT) sheet is 60 mm/sec. The process speed of 60 mm/sec is one-third the process speed in the plain paper print mode, and hence the print mode in which gloss paper or an OHT sheet is printed is hereinafter referred to as ⅓ speed mode.

The image forming apparatus 100 is provided with a temperature and humidity sensor 18 as temperature and humidity detecting means. The temperature and humidity sensor 18 detects an atmospheric environment in which the image forming apparatus 100 is used. The detected temperature and humidity are output to a CPU 22 in an engine control unit 17.

The CPU 22 uses the temperature and relative humidity input from the temperature and humidity sensor 18 to calculate the absolute humidity of the atmospheric environment, and stores information on the temperature of the atmospheric environment and information on the absolute humidity of the atmospheric environment in storing means 20 in one-tenths of a degree Celsius (on a 0.1° C. basis) and in one-tenths of a gram per cubic meter (on a 0.1 g/m$^3$ basis), respectively. The absolute humidity refers to the amount (g) of water vapor contained per unit volume of the atmospheric environment, and is measured in g/m$^3$. Where to install the temperature and humidity sensor 18 is not limited to the place illustrated in FIG. 4, and the temperature and humidity sensor 18 may be installed around the photosensitive drums 1 or in other places. The temperature detected by the temperature and humidity sensor 18 does not equal the actual temperature of the photosensitive drums 1 even when the temperature and humidity sensor 18 is placed around the photosensitive drums 1. Accordingly, switching developing biases based solely on temperature and humidity information of the temperature and humidity sensor 18 that is placed around the photosensitive drums 1 does not stabilize image density with respect to the photosensitive drum rotation time. It is therefore desirable to control the image producing process based on a prediction that takes into account the rotation time and stop time of the photosensitive drums 1 in addition to detection results of the temperature and humidity sensor 18 as the ones described in this embodiment.

Information on the temperature of the atmospheric environment and information on the absolute humidity of the atmospheric environment are, in this embodiment, stored in the storing means 20 on a 0.1° C. basis and on a 0.1 g/m$^3$ basis, respectively. However, the present invention is not limited thereto, and other basis may be used. While this embodiment uses the absolute humidity that is calculated from the temperature and the relative humidity, the absolute humidity that is measured directly may be used if it is possible.

Mono-component development is employed in this embodiment, but dual-component development may be employed instead. Developing means in the present invention may be one that uses a magnetic developer or one that uses a non-magnetic developer, and is not limited to one or the other. The present invention can employ any known developer that is used in electrophotography, and a developer optimum for the developing means is selected. The developer used in this embodiment is a non-magnetic developer.

The photosensitive drums 1 of the image forming apparatus 100 will be described below. The photoconductive layer of each photosensitive drum 1 is a laminate of layers having different functions: a charge generation layer which contains a charge generating substance, and a charge transport layer which contains a charge transporting substance. A surface layer is formed as a protective layer of the laminate photoconductive layer.

Figure 5:
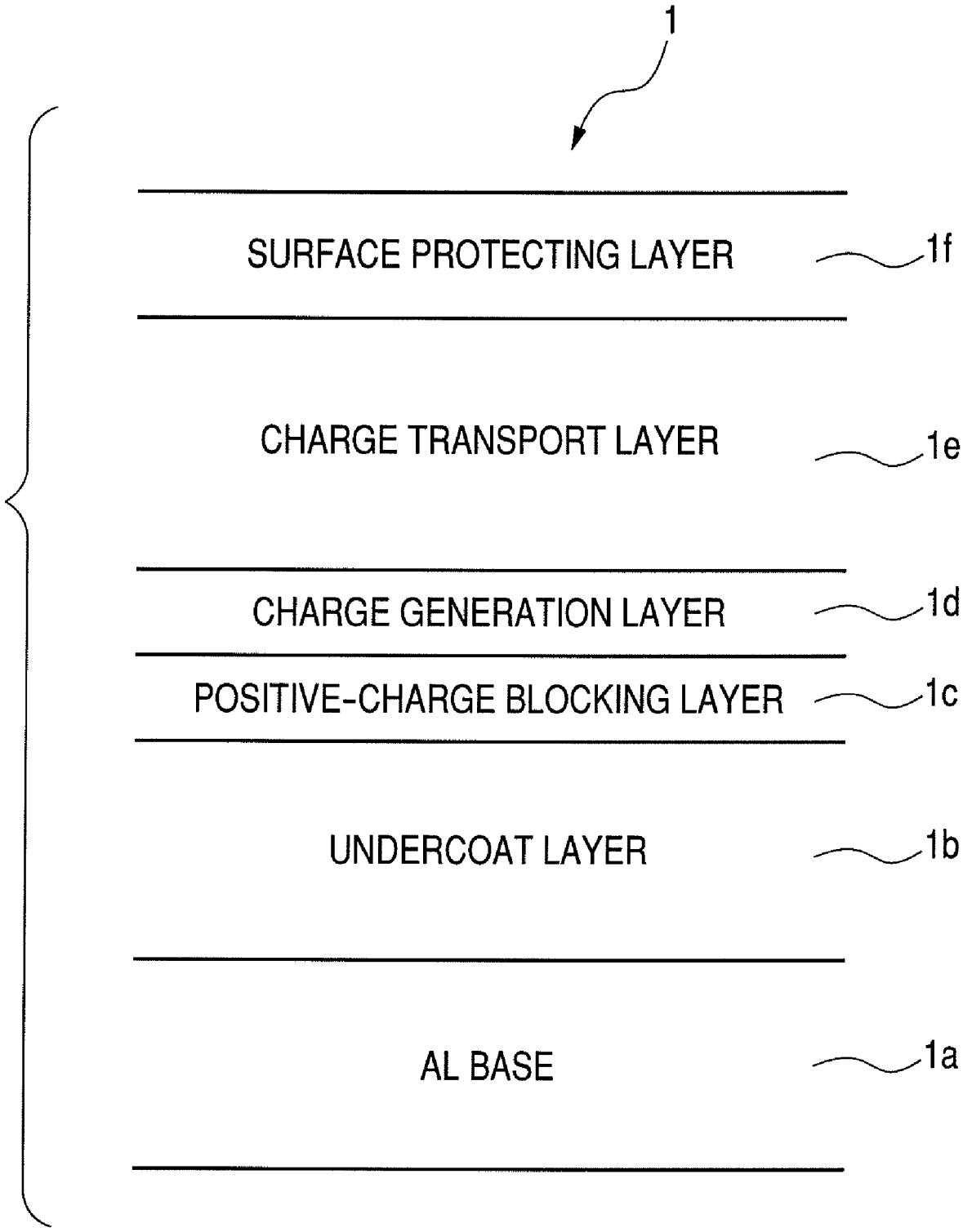
FIG. 5 is a sectional view of the photosensitive drum according to the present invention.

The layer structure of the photoconductive layer of each photosensitive drum 1 will be described with reference to FIG. 5.

An undercoat layer 1*b*, which has a barrier function and a bonding function, is provided on an aluminum (Al) base 1*a*, which is conductive and serves as a support member of the photosensitive member. Provided on the undercoat layer 1*b* is a positive-charge blocking layer 1*c* which has a medium resistance and a function to prevent positive charges injected from the aluminum base 1*a* from canceling out negative charges with which the surface of the photosensitive drum 1 is charged.

A charge generation layer 1*d* containing a charge generating substance is provided on the positive-charge blocking layer 1*c*. The charge generation layer 1*d* is formed by applying a coating liquid which is obtained by dispersing a charge generating substance along with a binder resin and a solvent, and by drying the applied liquid.

A charge transport layer 1*e* containing a charge transporting substance is provided on the charge generation layer 1*d*. The charge transport layer 1*e* is formed by applying a coating liquid which is obtained by dissolving a charge transporting substance and a binder resin in a solvent, and by drying the applied liquid.

A surface protecting layer 1*f* is provided as a surface layer on the charge transport layer 1*e*. The surface protecting layer 1*f* is a cured layer formed by applying a coating liquid that is a curable phenol resin dissolved in, or diluted with, a solvent on the photoconductive layer, and by letting a polymerization reaction happen after the application.

A method of controlling the image density of the image forming apparatus 100 in this embodiment will be described below.

Part of the image density control is keeping the maximum density of each color constant (hereinafter referred to as Dmax control), and keeping the halftone gradation characteristics linear with respect to image signals (hereinafter referred to as Dhalf control).

In Dmax control, the maximum density of each color is influenced by the film thickness of the photosensitive drum 1 and the atmospheric environment, and hence image forming conditions including the charging bias and the developing bias are set on the basis of results of detecting the environment and CRG tag information so that a desired maximum density is obtained.

In Dhalf control, non-linear input-output characteristics (γ characteristics) unique to electrophotography are prevented from causing a gap between an input image signal and an output density and thereby hindering the formation of a natural image. This is accomplished by performing such image processing that negates the γ characteristics and keeps the input-output characteristics linear. An optical sensor is used to detect multiple toner patches associated with different input image signals, and to obtain the relation between input image signals and the density. The obtained relation is used to convert an image signal to be input to the image forming apparatus in a manner that ensures that the input image signal produces a desired density. Dhalf control is performed after image-forming conditions including the charging bias and the developing bias are determined in Dmax control.

When VL fluctuations cause the density of an output image to change with time as the photosensitive member rotation time counts up, fluctuations in hue can be reduced by performing Dmax control and Dhalf control frequently, for example, for every five sheets printed. However, frequent Dmax control and Dhalf control are not practical because the printing speed is greatly reduced and the productivity of the image forming apparatus is lowered markedly. In this embodiment, Dmax control and Dhalf control are therefore performed only once for every 1,000 sheets printed. The schedule of performing Dmax control and Dhalf control is not limited to one in this embodiment, namely, once for every 1,000 sheets printed, but Dmax control and Dhalf control can be performed on a different schedule. The image forming apparatus may be structured so that Dhalf control is not performed even once. In addition, when to perform Dmax control and Dhalf control may be determined based on parameters other than the number of sheets printed, for example, the amount of toner consumed.

In this embodiment where Dmax control and Dhalf control are performed once for every 1,000 sheets printed, VL fluctuates greatly during a period between performances of Dmax and Dhalf control. Accordingly, controlling the image density through Dmax control and Dhalf control alone does not yield a stable image density. This embodiment therefore employs image density control methods other than Dmax control and Dhalf control. Specifically, image formation control successively corrects the charging bias or the developing bias (Vdev), which is determined through Dmax control by predicting VL fluctuations from the photosensitive member rotation time, the photosensitive member stop time, and the temperature and humidity, in a manner that keeps the development contrast (Vcont) constant.

Figure 1:
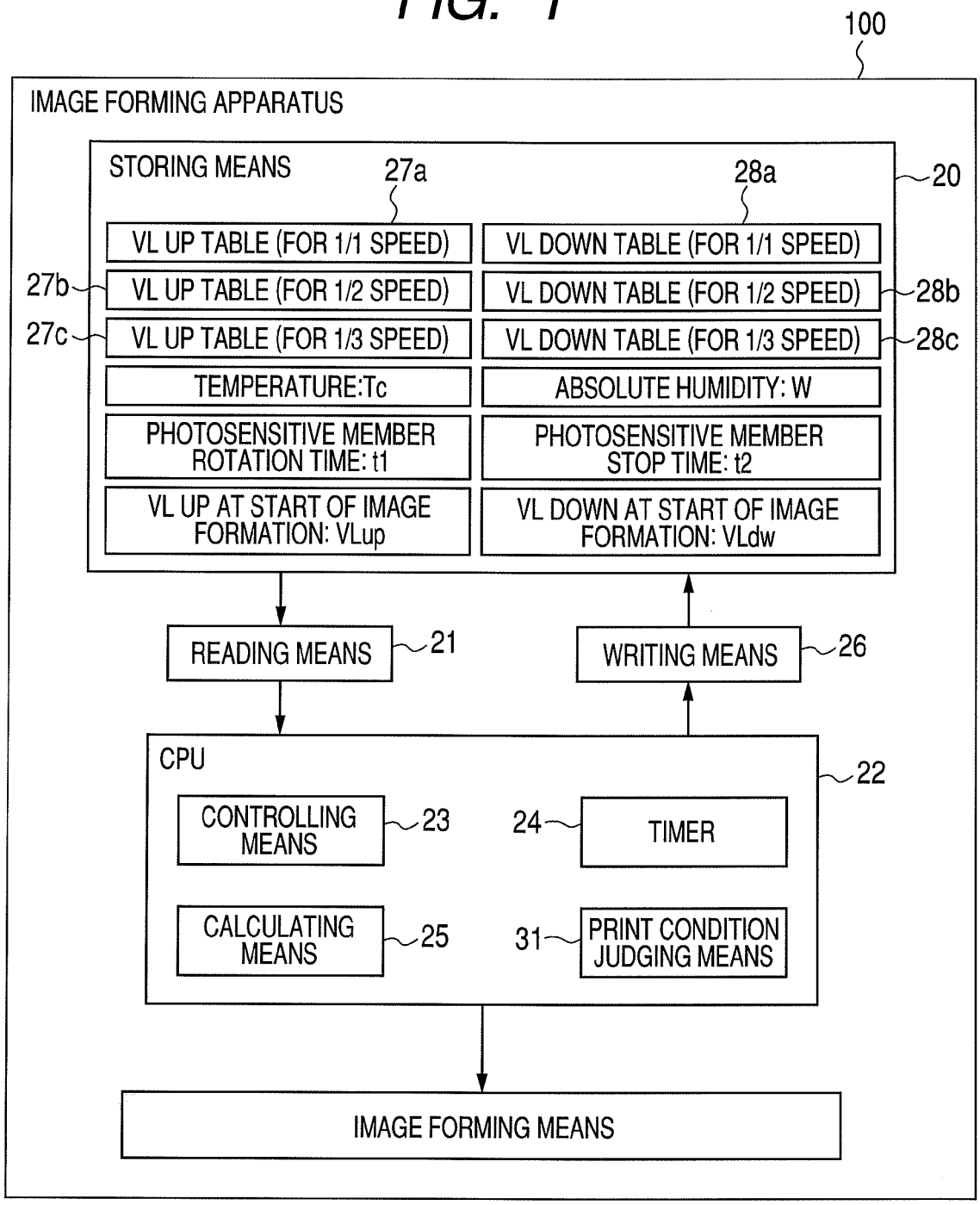
FIG. 1 is a block diagram of a system according to the present invention.
Figure 2:
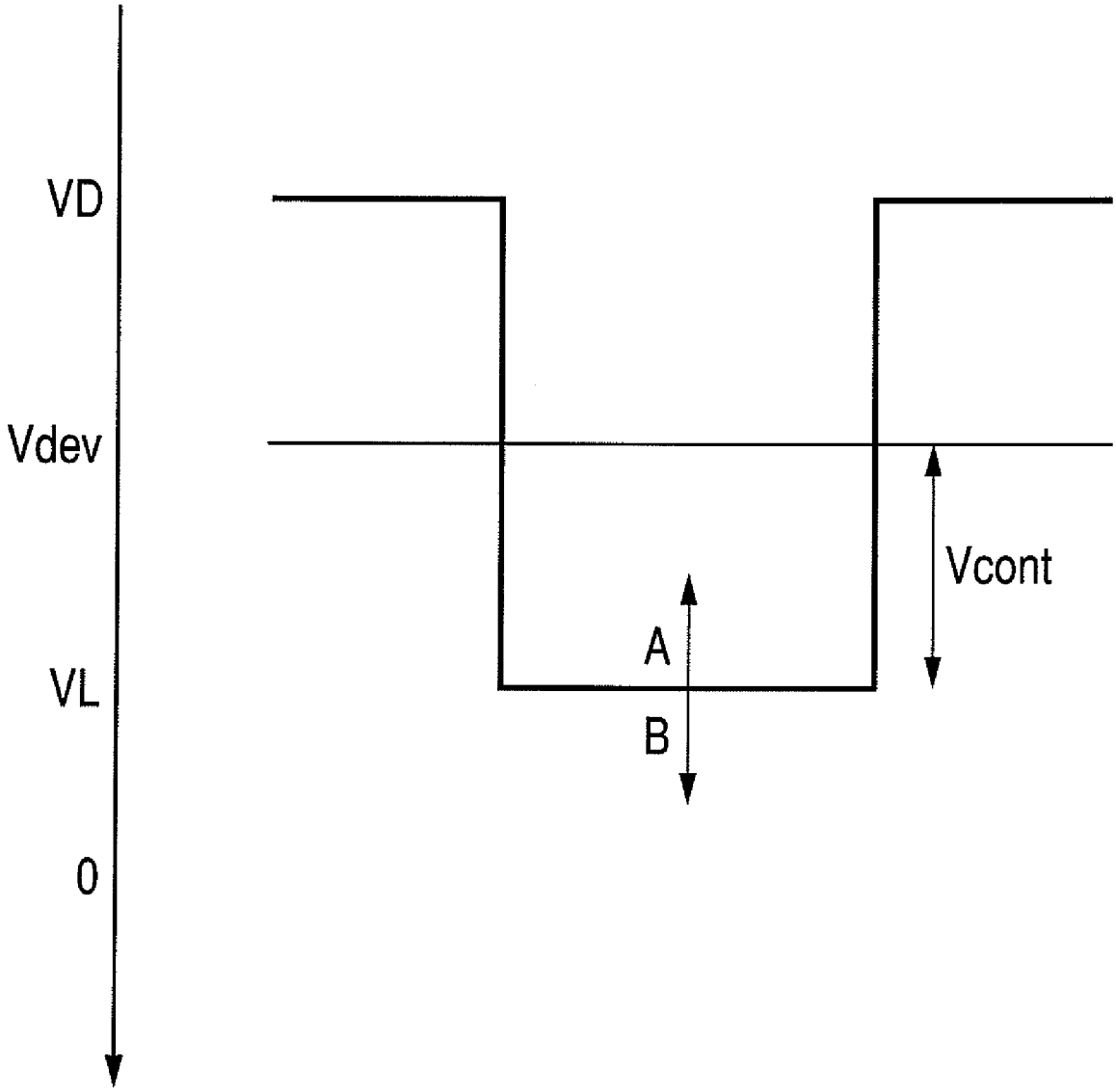
FIG. 2 is a diagram illustrating a concept of a surface potential of a photosensitive member.
Figure 3A:
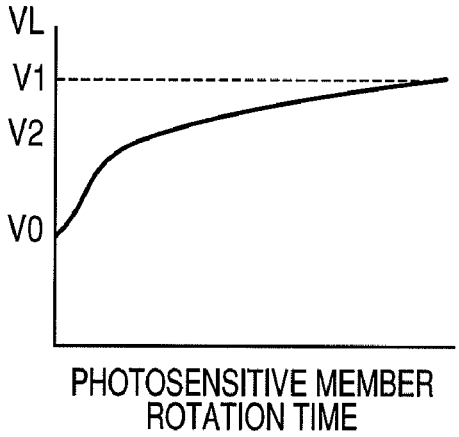
FIGS. 3A, 3B, 3C, 3D, 3E, and 3F are graphs illustrating a relation between a photosensitive drum rotation time and a surface potential of a photosensitive drum.
Figure 3B:
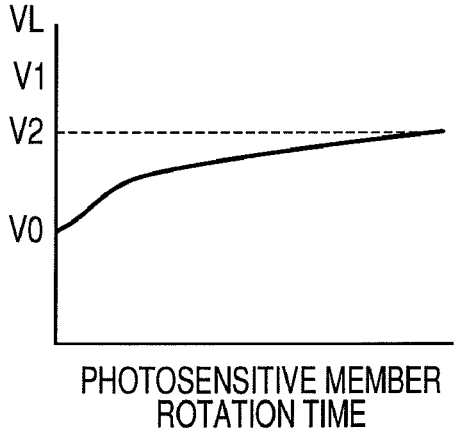
Figure 3C:
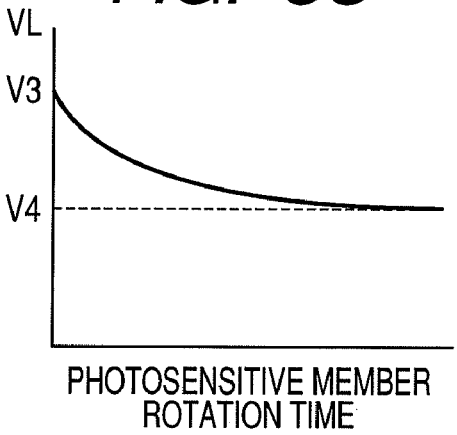
Figure 3D:
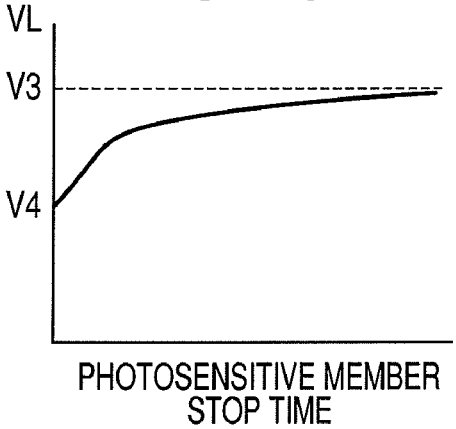
Figure 3E:
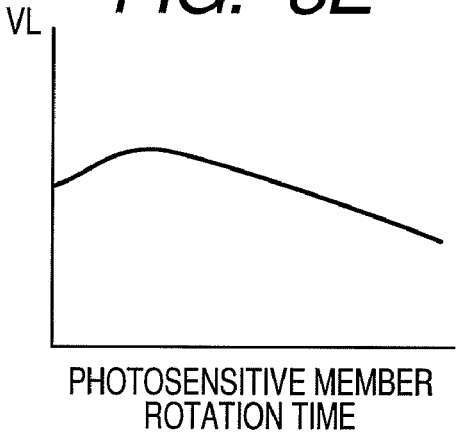
Figure 3F:
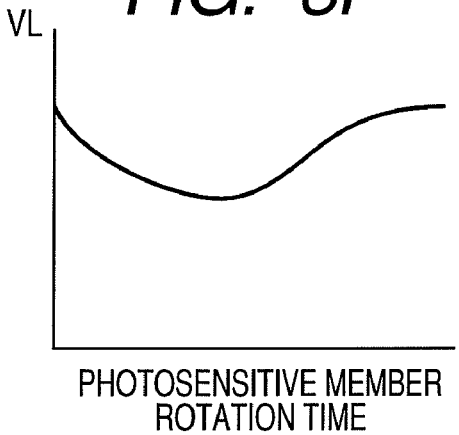

FIG. 1 is a block diagram of a system for image formation control in this embodiment. The storing means 20, the CPU 22, reading means 21, and writing means 26 are provided in an engine control unit 17 of the image forming apparatus 100 as illustrated in FIG. 4. The storing means 20 can be, but is not limited to, a known electronic memory. The storing means 20 in this embodiment may be a non-volatile EEPROM.

The CPU 22 includes: calculating means 25 which predicts VL fluctuations; controlling means 23 which controls image forming conditions based on a result of a VL fluctuation prediction made by the calculating means 25; a timer 24 which is time measuring means capable of measuring the photosensitive member rotation time and the photosensitive member stop time; and print condition judging means 31 which determines whether the current print speed is the 1/1 speed mode, the ½ speed mode, or the ⅓ speed mode.

The timer 24 counts the photosensitive member rotation time on the second time scale while the photosensitive drum 1 is being driven, and counts the photosensitive member stop time on the second time scale while the driving of the photosensitive drum 1 is stopped. The timer 24, which counts on a second-by-second time scale in this embodiment, may count on another time scale such as a minute time scale or any other scale containing divisions of time. The photosensitive member rotation time and the photosensitive member stop time measured by the timer 24 are stored in the storing means 20 via the writing means 26. While this embodiment uses the timer 24 to count both the photosensitive member rotation time and the photosensitive member stop time, two timers may be used to measure the photosensitive member rotation time and the photosensitive member stop time separately.

The image forming apparatus 100 is provided with the reading means 21 which reads information stored in the storing means 20. The reading means 21 sends information read out of the storing means 20 to the CPU 22. The read information is used by the calculating means 25 within the CPU 22 to predict VL fluctuations by a method described later. Based on the prediction made by the calculating means 25, the controlling means 23 sends information for controlling the image formation process to image forming means.

Image formation control in the image forming apparatus 100 of this embodiment will be described below. In order to stabilize image density when VL UP and/or VL DOWN occurs, image formation control is necessary so as to correct fluctuations in VL of the photosensitive drum 1 with respect to the photosensitive member rotation time. Such image formation control is accomplished by, for example, controlling the developing bias or controlling the charging bias as described above. In this embodiment, controlling the developing bias of the developing device 5 will be described as an example. For example, in the case where VL DOWN occurs, the calculating means calculates a correction amount (first correction amount) that acts to increase the absolute value of the charging bias (VD) by an amount lost due to VL DOWN. In the case where VL UP occurs, the calculating means calculates a correction amount (second correction amount) that acts to reduce the absolute value of the charging bias (VD) by an amount added due to VL UP. For another example, in the case where VL DOWN occurs, the calculating means calculates a correction amount (third correction amount) that acts to reduce the absolute value of the developing bias (Vdev) by an amount lost due to VL DOWN. In the case where VL UP occurs, the calculating means calculates a correction amount (fourth correction amount) that acts to increase the absolute value of the developing bias (Vdev) by an amount added due to VL UP.

Figure 6:
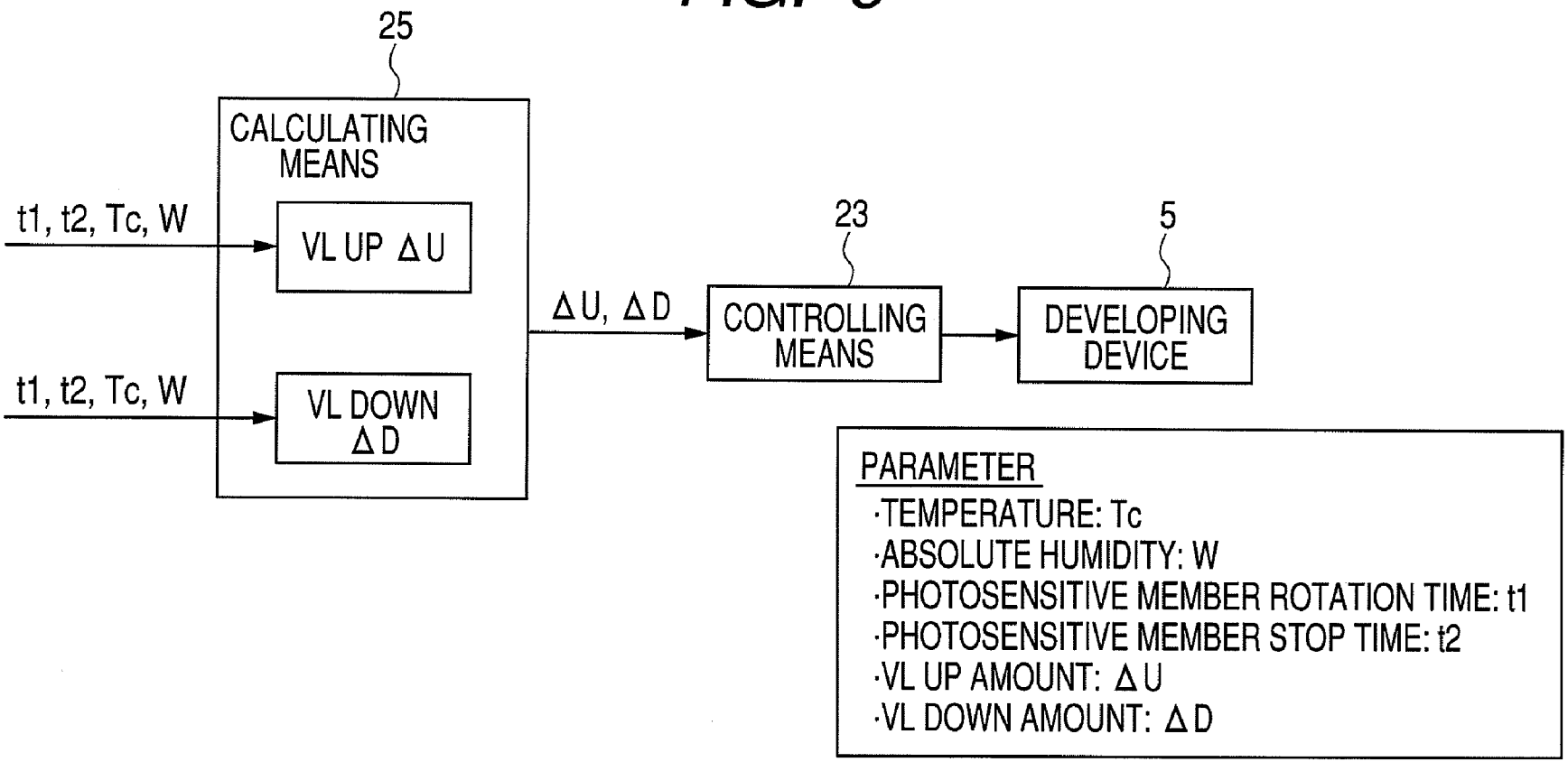
FIG. 6 is a conceptual diagram of process control according to the present invention.

FIG. 6 is a conceptual diagram of image formation control according to this embodiment. In this embodiment, the calculating means 25 calculates ΔU, which represents the number and/or extent of fluctuations due to VL UP, based on four parameters t1, t2, W, and Tc. The calculating means 25 also calculates ΔD which represents the number and/or extent of fluctuations due to VL DOWN, based on four parameters t1, t2, W, and Tc. ΔU is 0 or a negative value, whereas ΔD is 0 or a positive value.

Represented by t1 and t2 are the photosensitive drum rotation time and the photosensitive drum stop time, respectively. The environment temperature Tc and the absolute humidity W are values read by the temperature and humidity sensor 18 when the image forming apparatus 100 is powered on, and stored in the storing means 20.

In this embodiment, information is reset with t1 set to 0 at the start of the formation of a single image (one "unit" of an image-forming job). The photosensitive member rotation time t1 therefore corresponds to a photosensitive member rotation time counted from the start of the image formation to the execution of image forming condition control by the controlling device. In other words, t1 is information on a photosensitive member rotation time that is the time elapsed since the photosensitive member has started moving. Further, information is reset with t2 set to 0 at the end of the formation of a single image (one unit of the image-forming job). The photosensitive member stop time t2 therefore corresponds to a photosensitive member rotation stop time counted from the end of the preceding image formation to the start of the successive image formation. In other words, t2 is information on a photosensitive member stop time that is the time elapsed since the photosensitive has stopped moving.

The calculation of ΔU in this embodiment, details of which will be described later, uses W, Tc, and a substantial photosensitive drum rotation time t1*up* which is obtained from t1 and t2. Similarly, the calculation of ΔD uses W, Tc, and a substantial photosensitive drum rotation time t1*dw* which is calculated from t1 and t2.

This embodiment uses a substantial photosensitive member rotation time for VL UP count (hereinafter referred to as t1*up*) and a substantial photosensitive member rotation time for VL DOWN count (hereinafter referred to as t1*dw*) as individual parameters. In the following description, t1*up* and t1*dw* represent the respective substantial photosensitive member rotation times.

The calculating means 25 predicts how VL fluctuates and, based on the prediction, the controlling means 23 controls the developing bias Vdev (or the charging bias VD) to be applied to the developing device 5 in a manner that keeps Vcont constant.

Predicting VL fluctuations requires predicting fluctuations due to both VL UP and VL DOWN. The calculating means 25 predicts VL fluctuations by calculating the number and/or extent of VL UP fluctuations and the number and/or extent of VL DOWN fluctuations separately.

Details of a method employed by the calculating means 25 to calculate fluctuations in VL will be described below. Characteristics related to VL fluctuations are provided by a table stored in the storing means 20, and the calculating means 25 calculates VL fluctuations by referring to that table.

How to calculate VL UP fluctuations and how to calculate VL DOWN fluctuations are separately described below.

Described will be first provided of a method of calculating VL UP fluctuations. VL UP fluctuations are calculated by referring to tables (sets of control values), which are each specific to one of the process speeds, stored in the storing means 20 as illustrated in FIG. 1. The tables consulted are: a VL UP table 27*a* for the 1/1 speed mode (process speed 180 mm/sec); a VL UP table 27*b* for the ½ speed mode (process speed 90 mm/sec); and a VL UP table 27*c* for the ⅓ speed mode (process speed 60 mm/sec).

Each of the VL UP tables include a table A, a table B, and a table C as illustrated in FIGS. 7A, 7B, and 7C. The amount of VL UP fluctuations with respect to the photosensitive member rotation time is calculated based on those tables. The table A illustrates the amount of VL fluctuation with respect to the photosensitive member rotation time t1*up* as illustrated in FIG. 7A. The table B illustrates, in a 4×4 matrix, coefficients that are selected based on the temperature Tc and absolute humidity W of the atmospheric environment as illustrated in FIG. 7B.

The table C illustrates coefficients λ that are selected based on the photosensitive member stop time t2. For example, when t2=200 (S), λ=0. This means that the influence of residual charges contained in the photosensitive drum returns to a level closer to the original level as the photosensitive member stop time becomes longer. The amount of VL UP fluctuations ΔU with respect to the photosensitive member rotation time is calculated by multiplying the amount of the table A by a coefficient selected from the table B. FIG. 7A is a graph and is not in a table format, but the information may be kept in a table format in the table A.

As described above, the fluctuation amount AU due to the VL UP is calculated from three parameters, t1*up* (obtained from t1 and t2), W, and Tc. The reason for this will be described as follows.

As can be seen in the table A, the fluctuation amount ΔU (which is proportional to the y-axis of the graph in table A) is larger as the photosensitive member rotation time t1 becomes longer. For instance, in the table A, the fluctuation amount ΔU is substantially saturated at 10.5V when the photosensitive member rotation time t1 exceeds 30 s. However, in the case where the photosensitive member has already been rotating for 10 s and ΔU has reached 6V at the time when the counting of t1 is started, the fluctuation amount ΔU is saturated at 10.5 V when the photosensitive member rotation time t1 is past 20 s. Thus, basing the calculation of the correction value simply on the photosensitive member rotation time t1 does not yield an appropriate ΔU. The calculation of ΔU therefore uses the substantial photosensitive member rotation time t1*up* in which a state of the photosensitive member at the time when the counting of t1 is started is taken into account.

In this embodiment, the counting of t1 is started after information is reset with t1 set to 0 at the start of one unit of an image-forming job. This allows for adding the state of the photosensitive member at the start of t1 counting into consideration. Specifically, the state of the VL UP fluctuation amount of the photosensitive member (VLup) is obtained from "Vupend" and λ. Vupend represents the value of ΔU at the end of an image-forming job that immediately precedes the current image-forming job. λ represents a correction coefficient obtained from the photosensitive member stop time t2 that is counted from the end of the immediately preceding image-forming job to the start of the current image-forming job.

VLup is expressed as follows:

$$VLup=\lambda\times Vupend$$

The VLup value is converted into the photosensitive member rotation time t1 with the use of the table A, and the converted value is represented as t1*up_lk*. The value t1*up_lk* indicates for how long the photosensitive member has already been rotating at the time when the counting of t1 is started. An appropriate ΔU can be obtained by using the sum of t1*up_lk* and t1 as the substantial photosensitive member rotation time.

A method of calculating the amount of VL UP observed while the photosensitive drum 1 is being driven will be described. The amount ΔU of fluctuations due to VL UP in the process of image formation is calculated from the photosensitive member rotation time t1*up* and the table A. The time t1*up*, which is the substantial rotation time of the photosensitive drum 1 as described above, has a relation expressed by Numerical Expression 1. In other words, t1*up* is the sum of the time t1 elapsed since the photosensitive drum 1 started rotating in the current image-forming job and t1*up_lk* which indicates the state of the photosensitive member at the time when the current image-forming job is started.

$$t1up=t1+t1up_lk \qquad \text{Numerical Expression 1}$$

wherein t1 represents the time elapsed since the photosensitive drum 1 started rotating in the current image-forming job, and t1*up_lk* represents a time value obtained with the use of the table A. In other words, t1*up_lk* is obtained through a conversion from the VL UP amount of the photosensitive member at the time when the current image-forming job is started to an associated time found by use of the table A.

The VL UP amount calculated from the table A is multiplied by a coefficient that is selected from the table B of FIG. 7B based on the temperature Tc and absolute humidity W of the atmospheric environment. The VL UP amount ΔU with which the controlling means 23 controls image formation is thus determined.

After the image forming job is ended and the photosensitive drum 1 stops rotating, the calculating means 25 stores Vupend, which is the VL UP amount at the time when the photosensitive drum 1 stops rotating, in the storing means 20, and the timer 24 starts counting the photosensitive member stop time t2. The value of the photosensitive member stop time t2 that is counted from the end of the current image-forming job to the start of the subsequent image-forming job is used in selecting, from the table C of FIG. 7C, the coefficient λ by which Vupend is to be multiplied. When the subsequent image-forming job is started, VLup is obtained from the stored Vupend and the selected λ by Numerical Expression 2.

$$VLup=\lambda\times Vupend \qquad \text{Numerical Expression 2}$$

VLup is the VL UP amount of the photosensitive member at the time when the current image-forming job is started and is expressed by Numerical Expression 2. The value t1*up_lk* expressed by Numerical Expression 1 is one obtained using table A. In other words, t1*up_lk* is obtained by a conversion from an amount value VLup into a time value with the use of the table A.

A feature of this embodiment is that the VL UP amount immediately after the photosensitive drum 1 starts rotating is used in the calculation of t1*up_lk* through reverse operation with the use of the table A (control values) specific to the employed print speed mode. For example, in the case where the previous job is executed in the 1/1 speed mode and the current job is executed in the ⅓ speed mode, the VL UP amount immediately after the photosensitive drum starts rotating is converted into t1*up_lk* by reverse operation that uses the table A of the ⅓ speed mode.

Depending on the length of the photosensitive member stop time and to which print mode the switch is made, converting the VL UP amount immediately after the start of the photosensitive drum rotation into t1*up_lk* through reverse operation may not be possible. In such cases, the VL UP amount is fixed to the VL UP amount value immediately after the start of the photosensitive drum rotation, instead of calculating the VL UP amount with the use of the table A. This does not pose a problem if the calculation based on the photosensitive member stop time is performed again at the time when the photosensitive drum 1 stops rotating in the next time.

In this embodiment, the table A alone has a table dedicated to the 1/1 speed mode, a table dedicated to the ½ speed mode, and a table dedicated to the ⅓ speed mode, whereas the same table B and the same table C are used for all of the 1/1 speed mode, the ½ speed mode, and the ⅓ speed mode. However, the present invention is not limited thereto.

This embodiment prepares separate tables A for the 1/1 speed mode, the ½ speed mode, and the ⅓ speed mode, but the table A for the 1/1 speed mode may be multiplied by a coefficient in the double-sided print mode, whereby similar effects are obviously obtained.

A method of calculating VL DOWN fluctuations will be described below. Fluctuations due to VL DOWN are calculated by referring to tables (sets of control values), which are each specific to one of the process speeds, stored in the storing means 20 as illustrated in FIG. 1. The tables consulted are: a VL DOWN table 28*a* for the 1/1 speed mode (process speed 180 mm/sec); a VL DOWN table 28*b* for the ½ speed mode (process speed 90 mm/sec); and a VL DOWN table 28*c* for the ⅓ speed mode (process speed 60 mm/sec).

The VL DOWN tables include a table D, a table E, and a table F as illustrated in FIGS. 8A, 8B, and 8C. The amount of VL DOWN fluctuations with respect to the photosensitive member rotation time is calculated based on those tables. The table D illustrates the amount of VL fluctuations with respect to the photosensitive member rotation time t1*dw* as illustrated in FIG. 8A. The table E illustrates, in a 4×4 matrix, coefficients that are selected based on the temperature Tc and absolute humidity W of the atmospheric environment as illustrated in FIG. 8B.

The table F illustrates coefficients that are selected based on the photosensitive member stop time t2. This means that the risen temperature of the photosensitive drum returns to a temperature closer to the original temperature (i.e., temperature of the atmosphere) as the photosensitive member stop time is longer. The amount of VL DOWN fluctuations ΔD with respect to the photosensitive member rotation time is calculated by multiplying the amount of the table D by a coefficient selected from the table E. FIG. 8A is a graph and is not in a table format, but the graph may be kept in a table format in the table D.

As mentioned above, the VL DOWN fluctuation amount ΔD is calculated from three parameters, t1*dw* (obtained from t1 and t2), W, and Tc. The calculation uses the substantial photosensitive member rotation time t1*dw* for the same reasons that have been described about VLup.

In this embodiment, the counting of t1 is started after information is reset with t1 set to 0 at the start of one unit of an image-forming job. This allows for taking the state of the photosensitive member at the start of the measurement of t1 into consideration. Specifically, the state of the VL DOWN fluctuation amount of the photosensitive member (VLdw) is obtained from Vdwend and b. Vdwend represents the value of ΔD at the end of an image-forming job that immediately precedes the current image-forming job. Represented by b is a correction coefficient obtained from the photosensitive member stop time t2 that is counted from the end of the immediately preceding image-forming job to the start of the current image-forming job.

A method of calculating the amount of VL DOWN observed while the photosensitive drum 1 is being driven will be described. The VL DOWN fluctuation amount ΔD in the process of image formation is calculated from the photosensitive member rotation time t1*dw* and the table A. The time t1*dw*, which is the substantial rotation time of the photosensitive drum 1, has a relation expressed by Numerical Expression 3. In other words, t1*dw* is the sum of the time t1 elapsed since the photosensitive drum 1 started rotating in the current image-forming job and t1*dw_lk,* which indicates the state of the photosensitive member at the time when the current image-forming job is started.

$$t1dw = t1 + t1dw_lk \qquad \text{Numerical Expression 3}$$

where t1 represents the time elapsed since the photosensitive drum 1 started rotating in the current image-forming job, and t1*dw_lk* represents a time value obtained with the use of table D. In other words, t1*dw_lk* is obtained through a conversion in which the VL DOWN amount of the photosensitive member at the time when the current image-forming job is started is associated with a time value in table D. Table D is prepared for the employed print mode.

The VL DOWN amount calculated from the table D is multiplied by a coefficient that is selected from the table E of FIG. 8B based on the temperature Tc and absolute humidity W of the atmospheric environment. The VL DOWN amount ΔD with which the controlling means 23 controls image formation is thus determined.

After the image-forming job is ended and the photosensitive drum 1 stops rotating, the calculating means 25 stores Vdwend, which is the VL DOWN amount at the time when the photosensitive drum 1 stops rotating, in the storing means 20, and the timer 24 starts counting the photosensitive member stop time t2. The value of the photosensitive member stop time t2 that is counted from the end of the current image-forming job to the start of the subsequent image-forming job is used in selecting from the table F of FIG. 8C the coefficient b by which Vdwend is to be multiplied. When the subsequent image-forming job is started, VLdw is obtained from the stored Vdwend and the selected b by Numerical Expression 4.

$$VLdw = b \times Vdwend \qquad \text{Numerical Expression 4}$$

VLdw is the VL DOWN amount of the photosensitive member immediately after the photosensitive drum 1 starts rotating and is expressed by Numerical Expression 4. The time value t1*dw_lk* described in Numerical Expression 3 is one obtained with the use of the table D (by inputting VLdw) that has been prepared for the employed print mode.

In this embodiment, table D has within it a table (28*a* in FIG. 1) dedicated to the 1/1 speed mode, a table 28*b* dedicated to the ½ speed mode, and a table 28*c* dedicated to the ⅓ speed mode whereas the same table E and the same table F are used in common for the 1/1 speed mode, for the ½ speed mode, and for the ⅓ speed mode. However, the present invention is not limited thereto.

This embodiment prepares separate tables D for the 1/1 speed mode, for the ½ speed mode, and for the ⅓ speed mode, but the table D for the 1/1 speed mode may be multiplied by a coefficient in the ½ speed mode and the ⅓ speed mode, whereby effects similar to those in the 1/1 speed mode are obviously obtained.

The calculating means 25 uses the above-mentioned methods to calculate the VL UP fluctuation amount with the use of the VL UP tables 27*a*, 27*b*, and 27*c*, and to calculate VL DOWN fluctuation amount with the use of the VL DOWN tables 28*a*, 28*b*, and 28*c*. Based on those calculation results, the controlling means 23 sends information for controlling the developing bias of the developing device 5 to the image-forming means. In this embodiment, the developing bias is controlled in a manner that keeps the development contrast (Vcont) constant.

Figures 9, 9A:
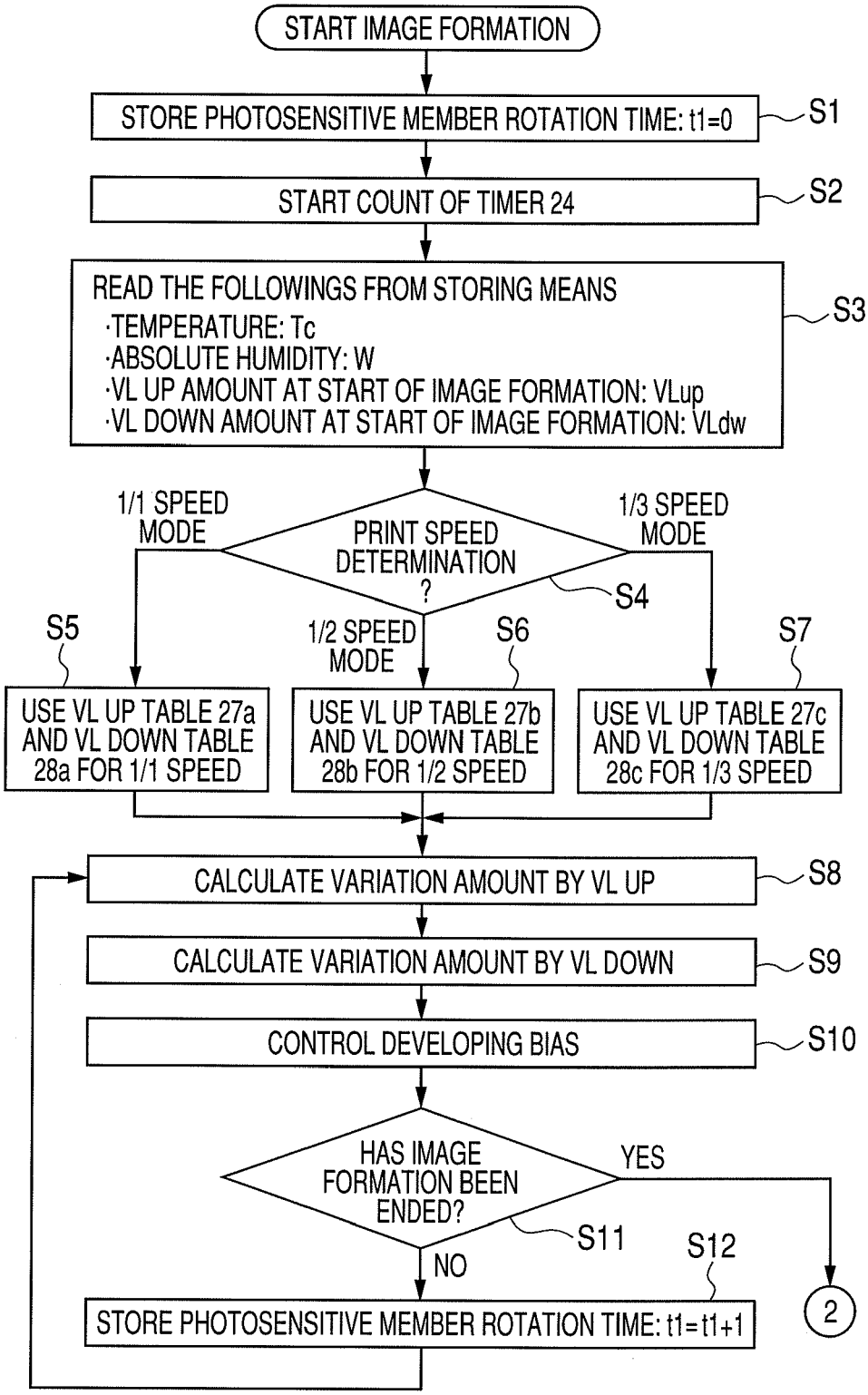
FIG. 9 (made up of FIGS. 9A and 9B) is a flowchart illustrating an operation of the image forming apparatus according to the present invention.
Figure 9B:
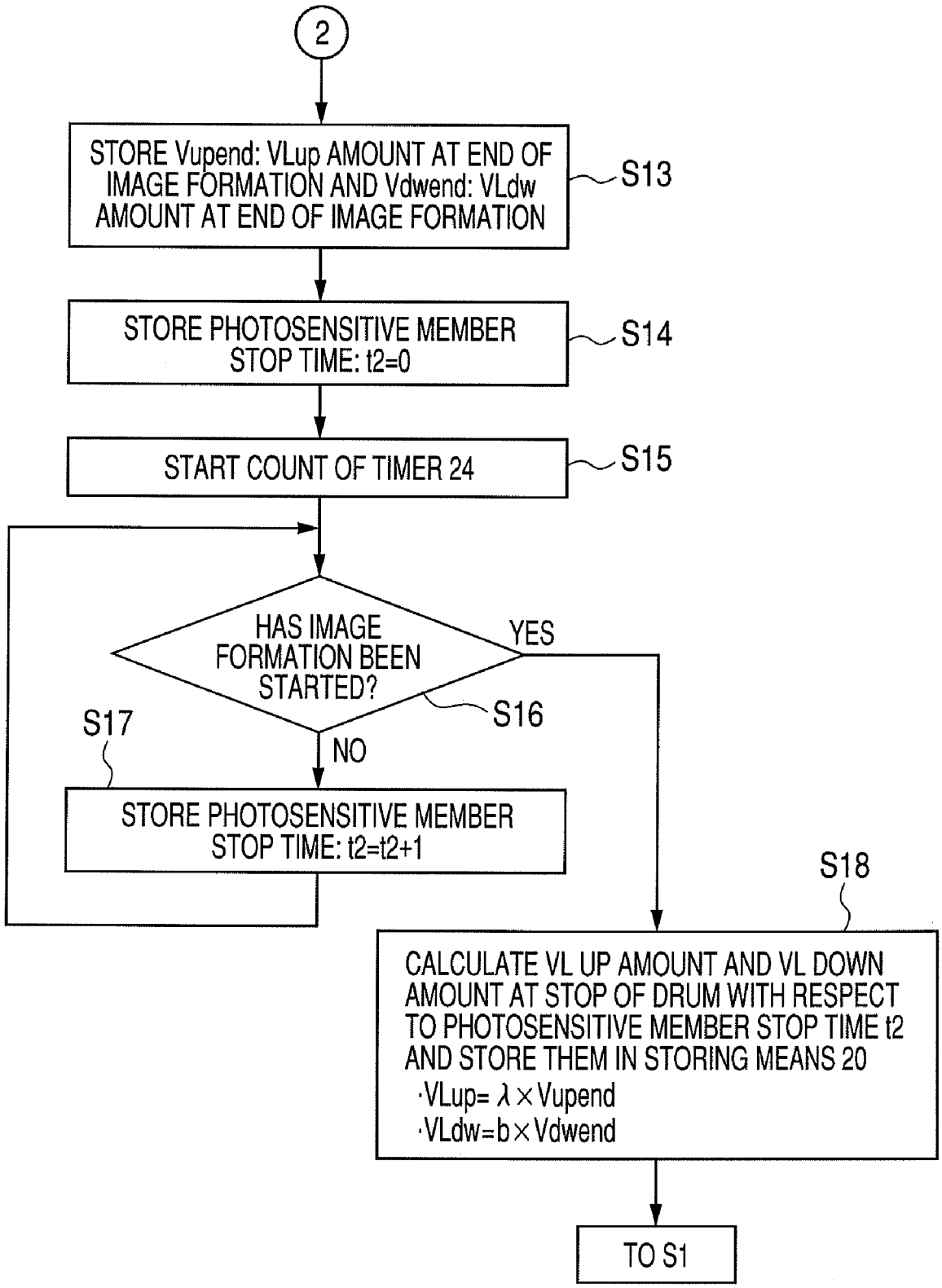

The flow of image formation control of this embodiment will be described below with reference to a flowchart of FIG. 9, which is made up of FIGS. 9A and 9B.

Upon instruction to start image formation, 0 is stored as the photosensitive member rotation time t1 in the storing means 20 in Step S1. In Step S2, the timer 24 starts counting time on the second time scale. In Step S3, the reading means 21 reads the environment temperature Tc, the absolute humidity W, the VL UP amount VLup at the start of image formation, and the VL DOWN amount VLdw at the start of image formation out of the storing means 20. The environment temperature Tc and absolute humidity W read in this step are values that have been read by the temperature and humidity sensor 18 when the image forming apparatus 100 has been powered on, and kept stored in the storing means 20.

In Step S4, the print condition judging means 31 determines which one of the 1/1 speed mode, the ½ speed mode, and ⅓ speed mode is employed for the process speed. In the case where the 1/1 speed mode is employed for the process speed, the VL UP table 27*a* for the 1/1 speed mode and the VL DOWN table 28*a* for the 1/1 speed mode are read out of the storing means 20 in Step S5. In the case where the ½ speed mode is employed for the process speed, the VL UP table 27*b* for the ½ speed mode and the VL DOWN table 28*b* for the ½ speed mode are read out of the storing means 20 in Step S6. In the case where the ⅓ speed mode is employed for the process speed, the VL UP table 27*c* for the ⅓ speed mode and the VL DOWN table 28*c* for the ⅓ speed mode are read out of the storing means 20 in Step S7.

In Step S8, the calculating means 25 uses the above-mentioned method to calculate the fluctuation amount ΔU due to the VL UP from the environment temperature Tc, the environment absolute humidity W, the VL UP amount VLup at the start of image formation, and the photosensitive member rotation time t1.

In Step S9, the calculating means 25 uses the above-mentioned method to calculate the fluctuation amount ΔD due to the VL DOWN from the environment temperature Tc, the environment absolute humidity W, the VL DOWN VLdw amount at the start of image formation, and the photosensitive member rotation time t1.

In Step S10, the calculating means 25 uses the fluctuation amount ΔU due to the VL UP obtained in Step S8 and the fluctuation amount ΔD due to the VL DOWN obtained in Step S9 to calculate ΔU+ΔD as the amount of fluctuations in VL. Based on this calculation result, the controlling means 23 controls the developing bias to be applied to the developing device 5 in a manner that keeps Vcont constant.

In Step S11, the CPU 22 determines whether or not the image formation is to be ended. In the case where the image formation is to be continued (Step S11: NO), the timer 24 increases the count of the photosensitive member rotation time t1 by one second in Step S12, and Step S8 to Step S11 are repeated until the image formation is finished. In the case where the image formation is to be ended in Step S11 (Step S11: YES), the CPU 22 proceeds to the calculation of the image formation suspension time, the process of which is illustrated in FIG. 9B.

In Step S13, the CPU 22 stores Vupend, which is the VL UP amount at the end of image formation, and Vdwend, which is the VL DOWN amount at the end of image formation, in the storing means 20.

In Step S14, 0 is stored as the photosensitive member stop time t2 in the storing means 20 and, in Step S15, the timer 24 starts counting time on the second time scale.

In Step S16, the CPU 22 determines whether or not image formation is to be started. In the case where image formation is to remain stopped (Step S16: NO), the count of the photosensitive member stop time t2 is increased by one second in Step S17, and Steps S16 and S17 are repeated until it is time to start image formation. In the case where image formation is to be started (Step S16: YES), the VL UP amount and the VL DOWN amount at the time when the photosensitive drum 1 is stationary are calculated in Step S18 by Numerical Expressions 2 and 4 based on the photosensitive member stop time t2, and stored in the storing means 20. The processing then shifts to Step S1 and subsequent steps, where the calculations for image formation are performed.

A feature of the present invention resides in the rotation speed of the photosensitive member in an image formation preceding a subsequent image formation of interest being taken into consideration in changing image-forming conditions for that subsequent image formation, instead of using the rotation speed of the photosensitive member in the subsequent image formation. This is because a rise in temperature of the photosensitive drum depends on the rotation speed of the photosensitive member in the preceding image formation, not the rotation speed of the photosensitive member in the subsequent image formation. VLup and VLdw read in Step S3 are both VL fluctuation parameters that are calculated by taking into account the rotation speed of the photosensitive member in the preceding image formation. The VL fluctuation amounts calculated in Step S8 and Step S9 are the same as VLup and VLdw in that the rotation speed of the photosensitive member in the image formation preceding the subsequent image formation is taken into account.

Next, effects obtained in this embodiment will be described through a comparison between a case in which process control of this embodiment is performed and a case in which process control of this embodiment is not performed (Comparative Example). In this Comparative Example, none of process control of this embodiment was performed. In other words, the developing bias had a fixed value. The image forming apparatus of the conventional art example has the same structure as that of the image forming apparatus 100 of this embodiment, except that the above-mentioned image formation control is not performed.

Figure 10A:
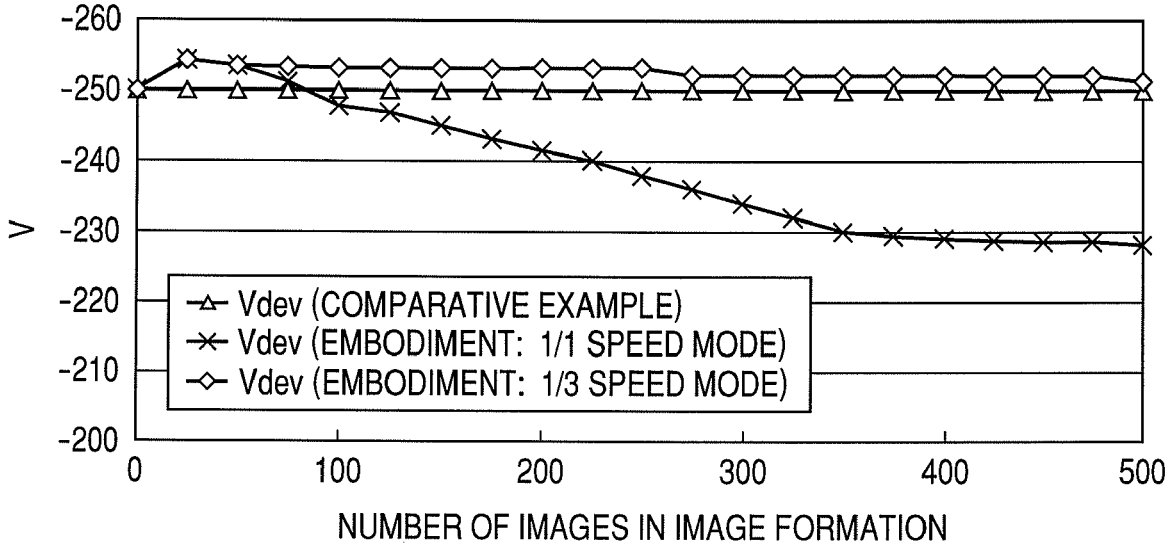
FIGS. 10A and 10B are graphs illustrating a transition of the surface potential of the photosensitive drum and a transition of a developing bias with respect to the number of images in image formation in an embodiment of the present invention, in an L/L environment.
Figure 10B:
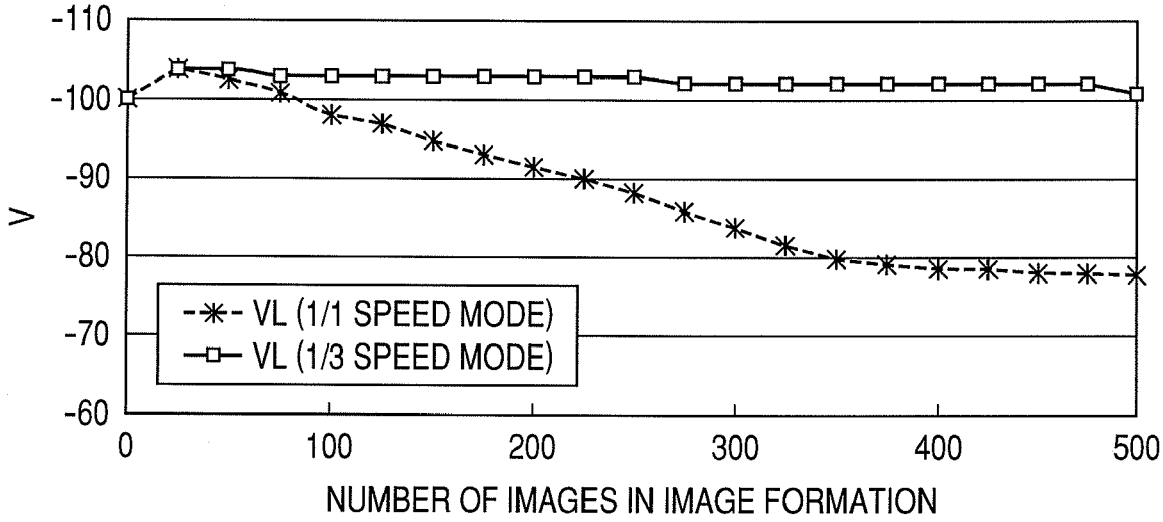

FIGS. 10A and 10B show the transition of VL (FIG. 10B) and the transition of the developing bias Vdev (FIG. 10A) in an L/L (Low temperature/low humidity) (15° C., 10% RH, absolute humidity: 1.06 g/m$^3$) environment. The transitions have been observed when image formation is performed on 500 sheets in succession in the 1/1 speed mode and in the ⅓ speed mode after Dmax control and Dhalf control are executed in the Comparative Example and in the embodiment of the present invention. The photosensitive member stop time t2 before the start of this image formation operation is 12,000 seconds.

FIG. 10B shows that, in the 1/1 speed mode, VL has increased by 3 to 4 V around the 25 to 50 sheets printed after the start of printing. VL DOWN has occurred subsequently and, after 500 sheets printed, VL has decreased by 21 V from the level at the start of the printing. This is probably because the fast rotation speed of the photosensitive member 1 has increased the influence of friction between the photosensitive drum 1 and the cleaning member 16Y, which is in contact with the photosensitive drum 1, thereby the temperature of the photosensitive drum 1 becomes apt to be increased.

In the ⅓ speed mode, VL UP has again occurred around the 25 to 50 sheets printed after the start of the image formation. VL DOWN has hardly occurred in the printing of remaining sheets and there is still no VL DOWN after 500 sheets printed. This is probably because the slow rotation speed of the photosensitive member 1 has reduced the influence of friction between the photosensitive drum 1 and the cleaning member 16Y, which is in contact with the photosensitive drum 1, with the result that the temperature of the photosensitive drum 1 becomes difficult to be increased.

FIG. 10A shows that this embodiment, where a suitable developing bias is selected for each of VL fluctuations in the 1/1 speed mode and VL fluctuations in the ⅓ speed mode as those shown in FIG. 10B, has therefore been successful in keeping Vcont constant. Image density fluctuations after 500 sheets printed have accordingly been small.

Comparative Example where the developing bias is not variable, on the other hand, has experienced Vcont fluctuations in 500-sheet printing in both the 1/1 speed mode and in the ⅓ speed mode. The graphs shown in FIG. 10B apply to the Comparative Example as well as to the present embodiment. The horizontal line in FIG. 10A represents the lack of adjustment of Vdev in the Comparative Example. As a result, image density fluctuations observed in the 1/1 speed mode are as follows. VL UP has occurred around the 25 to 50 sheets printed after the start of the image formation, reducing Vcont and thus lowering the image density. VL DOWN has subsequently occurred, increasing Vcont and thus raising the image density. Image density fluctuations observed in the ⅓ speed mode are as follows. The almost non-existent influence of VL DOWN in the ⅓ speed mode has made the influence of VL UP dominant from the start to end of the 500-sheet printing, thereby reducing Vcont and lowering the image density.

The effects of the present invention have been obtained not only in successive printing, but also in intermittent printing and in printing that switches from the 1/1 speed mode to the ⅓ speed mode. In the opposite case where a switch is made from the ⅓ speed mode to the 1/1 speed mode, too, this embodiment has been confirmed to be successful in stabilizing the density.

While this embodiment has described the effects of the present invention on image density fluctuations in 1/1 speed mode printing and ⅓ speed mode printing, the same effects can also be obtained when printing is executed at other print speeds.

In this embodiment, the developing bias was controlled based on a prediction of fluctuations in the surface potential VL of the photosensitive drum 1. Alternatively, the developing bias may be controlled based on a prediction of fluctuations in the electric potential of a halftone image portion Developing bias was controlled on a second-by-second time scale in this embodiment, but may be controlled on another time scale. For example, the developing bias may be controlled by five-tenths of one second (on a 0.5 second basis), or by one page (on a page-by-page basis).

In this embodiment, the developing bias was controlled as a way of image formation control for keeping Vcont constant based on a prediction of how VL fluctuates. Alternatively, the charging bias may be controlled. Specifically, Vcont is kept constant by changing the charging bias consecutively based on the prediction of VL fluctuates while keeping the developing bias constant. This is accomplished by storing a table that illustrates the relation between the charging bias and the predicted VL in the storing means 20, and by controlling the charging bias in a manner that keeps VL constant all the time. The charging bias is set low in the case where VL goes up due to ΔU and ΔD, and set high in the case where VL goes down due to ΔU and ΔD.

The above-mentioned method ensures that uniform density images can be always obtained even when the charging bias is controlled as a way of image formation control. Alternatively, the charging bias and the developing bias may both be controlled based on the prediction of VL fluctuates.

As can be seen in FIG. 8A, in this embodiment, ΔD is larger in the 1/1 speed mode than in the ⅓ speed mode. Accordingly, under the same conditions in terms of temperature and humidity, photosensitive member rotation time, and photosensitive member stop time, the charging bias is controlled to have a larger absolute value in the 1/1 speed mode than in the ⅓ speed mode. In the case where developing bias is controlled, the developing bias is controlled to have a smaller absolute value in the 1/1 speed mode than in the ⅓ speed mode.

In this embodiment, the temperature and humidity of the atmospheric environment are measured in a period between the time when the image forming apparatus is powered on and the time when the image forming apparatus reaches a standby state ready for image formation, and the temperature T and the absolute humidity W are stored in the storing means. This is because the temperature and the absolute humidity at the time when the image forming apparatus is powered on are deemed as substantially equal to the temperature and absolute humidity of the surface of the photosensitive drum 1 at that time. The temperature T and the absolute humidity W at the time when the power is turned on are used in predicting VL fluctuations.

If the temperature and the humidity at the time when the power is turned on differ greatly from the temperature and humidity on the surface of the photosensitive drum 1, VL fluctuations cannot be predicted with accuracy. Therefore, when the temperature and the humidity at the time when the power is turned on obviously differ from the temperature and humidity on the surface of the photosensitive drum 1, the image forming apparatus may choose not to perform the prediction-control of the VL fluctuations. An example of this choice is a case in which power failure stops the image forming apparatus in the middle of successive image formation and then the image forming apparatus is immediately powered on. In this case, because the image forming apparatus has been forming images, the temperature on the surface of the photosensitive drum 1 is likely to differ from the temperature of the atmospheric environment significantly. Whether or not the temperature and humidity of the surface of the photosensitive drum 1 greatly differ from the temperature and humidity of the atmospheric environment can be determined by, for example, the following structure. Fixing temperature measuring means 14*a* which measures the temperature of the fixing device 14 is provided and measures the temperature of the fixing device 14 at the time when the image forming apparatus is powered on. In the case where the temperature of the fixing device is larger than a given value, it is suspected that the image forming apparatus was stopped in the middle of successive image formation as described above. The image forming apparatus therefore may be set so that, when the temperature of the fixing device at the time when the power is turned on is larger than the given value, the control for changing the image forming conditions based on the VL fluctuations may not be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2008-138049, filed May 27, 2008, and No. 2009-092312, filed Apr. 6, 2009, which are hereby incorporate by reference herein in their entirety.

What is claimed is:

1. An image forming apparatus, comprising:

a photosensitive member which has a rotatable surface;

an image forming unit which is configured to form an image on the photosensitive member;

a time measuring unit which is configured to measure a photosensitive member rotation time and a photosensitive member stop time, the photosensitive member rotation time being a period of time elapsed from a time when the photosensitive member starts rotating, the photosensitive member stop time being a period of time elapsed from a time when the photosensitive member stops rotating;

a temperature and humidity detector which is configured to detect information about temperature and humidity of a part of an environment of the image forming apparatus;

a speed switching unit which is configured to change a rotation speed of the photosensitive member; and a controller which is configured to control an image forming condition of the image forming unit, the controller being configured to determine an image forming condition for a first image formation process based on the photosensitive member rotation time, the photosensitive member stop time, the information about the temperature and humidity, and information about the rotation speed of the photosensitive member of an image formation process that precedes the first image formation process.

2. An image forming apparatus according to claim 1, wherein the image forming unit comprises:

a charging device which is configured to charge the rotatable surface of the photosensitive member;

an exposure device which is configured to form an electrostatic latent image by exposing the photosensitive member to light; and a developing device which is configured to supply a developer to the electrostatic latent image to form a developer image.

3. An image forming apparatus according to claim 1, wherein the controller is configured to calculate an absolute humidity based on a temperature and a relative humidity detection result by the temperature and humidity detector, and wherein the controller is further configured to change the image forming condition in accordance with the temperature, the absolute humidity, the photosensitive member rotation time, and the photosensitive member stop time.

4. An image forming apparatus according to claim 2, wherein the image forming condition comprises at least one of a charging bias applied to the charging device and a developing bias applied to the developing device.

5. An image forming apparatus according to claim 4, wherein the controller comprises a first calculating unit which is configured to calculate a first correction amount and a second correction amount, the first correction amount acting to increase an absolute value of a charging bias, the second correction amount acting to reduce the absolute value of the charging bias, and wherein the charging bias is controlled based on the first correction amount and the second correction amount.

6. An image forming apparatus according to claim 4, wherein the controller comprises a second calculating unit which is configured to calculate a third correction amount and a fourth correction amount, the third correction amount acting to reduce an absolute value of a developing bias, the fourth correction amount acting to increase the absolute value of the developing bias, and wherein the developing bias is controlled based on the third correction amount and the fourth correction amount.

7. An image forming apparatus according to claim 5, wherein the first calculating unit is configured to calculate the first correction amount so that the absolute value of the charging bias is increased as the photosensitive member rotation time becomes longer, and to calculate the first correction amount so that the absolute value of the charging bias is reduced as the photosensitive member stop time becomes longer.

8. An image forming apparatus according to claim 5, wherein the first calculating unit is configured to calculate the second correction amount so that the absolute value of the charging bias is reduced as the photosensitive member rotation time becomes longer, and calculates the second correction amount so that the absolute value of the charging bias is increased as the photosensitive member stop time becomes longer.

9. An image forming apparatus according to claim 6, wherein the second calculating unit is configured to calculate the third correction amount so that the absolute value of the developing bias is reduced as the photosensitive member rotation time becomes longer, and to calculate the third correction amount so that the absolute value of the developing bias is increased as the photosensitive member stop time becomes longer.

10. An image forming apparatus according to claim 6, wherein the second calculating unit is configured to calculate the fourth correction amount so that the absolute value of the developing bias is increased as the photosensitive member rotation time becomes longer, and to calculate the fourth correction amount so that the absolute value of the developing bias is reduced as the photosensitive member stop time becomes longer.

11. An image forming apparatus according to claim 5, wherein the first calculating unit is configured to calculate the first correction amount so that the absolute value of the charging bias is increased as the rotation speed of the photosensitive member becomes higher under the same conditions of the temperature and humidity, the photosensitive member rotation time, and the photosensitive member stop time.

12. An image forming apparatus according to claim 6, wherein the second calculating unit is configured to calculate the third correction amount so that the absolute value of the developing bias is reduced as the rotation speed of the photosensitive member becomes higher under the same conditions of the temperature and humidity, the photosensitive member rotation time, and the photosensitive member stop time.

13. An image forming apparatus according to claim 1, wherein, when the rotation speed of the photosensitive member is changed, the image forming condition is determined in accordance with a changed rotation speed of the photosensitive member.

14. An image forming apparatus, comprising:

a photosensitive member which has a rotatable surface;

an image forming unit which is configured to form an image on the photosensitive member;

a speed switching unit which is configured to change a rotation speed of the photosensitive member; and a controller which is configured to control an image forming condition of the image forming unit, the controller being configured to determine an image forming condition for a first image formation process based on information about the rotation speed of the photosensitive member in an image formation process that precedes the first image formation process.

15. An image forming method, comprising:

starting an image formation process including applying to a photosensitive surface of a photosensitive rotating drum: a charging electric potential for charging the photosensitive surface, an exposure electric potential for reducing the potential at predetermined areas of the photosensitive surface to create a latent image on the photosensitive surface, and a developing electric potential for developing the latent image;

reading, from information stored regarding a previous image formation process, ambient temperature, ambient humidity, and information regarding fluctuations in the exposure electric potential;

calculating a fluctuation amount of electric potential of the photosensitive surface of the photosensitive rotating drum based on the information regarding fluctuations in exposure electric potential and a coefficient determined from stored relationships between temperature, humidity and exposure electric potential;

monitoring the photosensitive rotating drum rotating time and stopping time between rotating times;

determining a stopping-time exposure electric potential at a time when the photosensitive rotating drum rotating time stops;

reading, from stored relationship information between the stopping time and a range of coefficients, a coefficient associated with the monitored stopping time;

calculating a fluctuation in exposure electric potential based on a product of the stopping time exposure electric potential and the coefficient; and controlling at least one of the developing electrical potential and the charging electrical potential to compensate for the fluctuation amount of electric potential of the photosensitive surface.

* * * * *